US005474341A

United States Patent [19]

Putman et al.

[11] Patent Number: 5,474,341

[45] Date of Patent: Dec. 12, 1995

[54] GRAVITY ACTUATED CONTAINER LOCK

[75] Inventors: Peter B. Putman, Angola; Jerry A. Hampel, Elkhart, both of Ind.

[73] Assignee: Fikes, Inc., Angola, Ind.

[21] Appl. No.: 272,556

[22] Filed: Jul. 11, 1994

[51] Int. Cl.[6] ..... B65D 45/02; B65D 45/04; B65D 45/06

[52] U.S. Cl. ..... 292/230; 220/315; 220/908; 414/407; 292/DIG. 4; 292/DIG. 2

[58] Field of Search ..... 220/315, 318, 220/908; 292/DIG. 4, DIG. 22, 230; 414/407

[56] References Cited

U.S. PATENT DOCUMENTS

| | | | |
|---|---|---|---|
| 3,731,837 | 5/1973 | Platts et al. . | |
| 3,989,162 | 11/1976 | Hodge et al. | 220/908 X |
| 4,152,979 | 5/1979 | Schmidt . | |
| 4,155,584 | 5/1979 | Pracchia | 294/68.26 |
| 4,180,716 | 12/1979 | Galer . | |
| 4,182,530 | 1/1980 | Hodge . | |
| 4,212,410 | 7/1980 | Galer . | |
| 4,520,945 | 6/1985 | Hodge . | |
| 4,585,139 | 4/1986 | Bronson et al. . | |
| 4,609,117 | 9/1986 | Pamment . | |
| 4,809,850 | 3/1989 | Laible et al. . | |
| 4,955,501 | 9/1990 | Hodge . | |
| 5,011,360 | 4/1991 | Abram et al. . | |
| 5,029,724 | 7/1991 | Serio . | |
| 5,042,856 | 8/1991 | Goodman . | |
| 5,085,341 | 2/1992 | Hodge . | |
| 5,090,753 | 2/1992 | Goodman . | |
| 5,094,358 | 3/1992 | Serio, Sr. | 220/908 X |
| 5,094,487 | 3/1992 | Drewry . | |
| 5,118,000 | 6/1992 | Howell et al. . | |
| 5,135,129 | 8/1992 | Joly . | |
| 5,201,434 | 3/1993 | DeVivo et al. . | |
| 5,224,744 | 6/1993 | Michelutti | 220/908 X |
| 5,415,314 | 5/1995 | McCollum | 220/315 |

*Primary Examiner*—Allan N. Shoap
*Assistant Examiner*—Robin A. Hylton
*Attorney, Agent, or Firm*—Lundy and Associates

[57] ABSTRACT

A locking mechanism for a container having a hinged lid comprising a shaft adapted to be secured to a container and journaled for rotation about its axis. A locking bar is removably secured to the shaft and rotatable about the axis with the shaft between a locked position and an unlocked position. A lock lever is secured to the shaft between the locked position and the unlocked position and a roller is mounted on a track over the lock lever for motion into and out of an engagement with a lock lever. The shaft is held from rotation when the roller and the locking bar is in the locking position. The locking bar is free to move into and out of its locked and unlocked position and the roller is moved from its locking position.

19 Claims, 3 Drawing Sheets

GRAVITY ACTUATED CONTAINER LOCK

BACKGROUND OF THE INVENTION

The present invention relates to the field of locking mechanisms, and more particularly, relates to a lock for the lids of front load waste containers of the type commonly known as dumpster containers.

Trash or waste containers are becoming more and more common. Many of these containers are provided with locking mechanisms to prevent unauthorized usage of the container. Examples of container lid locks are disclosed in U.S. Pat. Nos. 4,534,488 and 5,094,358. There are few available locking mechanisms for container lids of trash receptacles. There are even fewer locking mechanisms which may be retro-fitted onto a broad variety of existing containers of a variety of sizes.

Most recently, mechanized trash removal has become preferable. A large number of different sized trash bins are available usually in a rectangular shape with a hinged lid attached to one side thereof. The container further includes attachments for accommodating various fork lifting mechanisms of a trash removal vehicle. The containers are lifted by the lifting mechanisms of the trash removal vehicle and pivoted in some fashion so that the hinged top container opens and the trash contained therein is emptied into the vehicle. The container is then returned to its position on the ground and the hinged lid of the container closes on top of the container. These dumpster containers are becoming more and more prevalent as trash removal becomes more and more mechanized.

Many of these trash containers are rented from a trash removal service. These receptacles are not provided free of charge, and consequently, their frequent emptying and service are sometimes a considerable expense. This expense is increased when unauthorized users of the receptacle freely deposit trash into the container. This unauthorized use necessitates a more frequent emptying of the container and, of course, the unauthorized user does not contribute to the increased expense. Additionally, when trash is segregated into recyclables, it is highly desirable to prevent unauthorized usage of these containers such that the trash may be properly segregated and not contaminated with trash of an unwanted kind.

For the forgoing reasons, there has existed a need to create a locking mechanism for these containers which is simple and reliable and which can be either originally provided or retro-fitted to existing dumpster containers.

In as much as dumpster containers need to be locked for the same reasons as other trash containers, the locks used on dumpster containers must be releasable to allow the lids to open automatically when the trash container is lifted by the trash removal vehicle and pivoted to empty the container.

It is therefore highly desirable to provide an improved lid lock.

It is therefore highly desirable to provide an improved lid lock for dumpster containers.

It is also highly desirable to provide an improved lid lock for a waste container which may be retro-fitted to a wide variety of different types and sizes of containers.

It is also highly desirable to provide an improved lid lock for a dumpster container which is simple and reliable and which can either be originally provided or retro-fitted to existing containers.

It is also highly desirable to provide an improved lid lock which may be secured to containers which are either all metal or partially metal.

It is also highly desirable to provide an improved lid lock which may be used on a wide variety of differently sized containers.

It is also highly desirable to provide an improved lid lock which can be changed in a dimension to accommodate differently sized containers easily while not altering the basic operation of the locking mechanism.

It is also highly desirable to provide an improved lid lock which automatically opens upon the pivoting of the container to open the hinged top of the container such that the container may be emptied and returned to its ground location without having to manually unlock the container.

It is finally highly desirable to provide an improved lid lock which meets all of the above described features.

SUMMARY OF THE INVENTION

It is therefore an object of the invention to provide an improved lid lock.

It is also an object of the invention to provide an improved lid lock for containers.

It is also an object of the invention to provide an improved lid lock for a waste container which may be retro-fitted to a wide variety of different types and sizes of containers.

It is also an object of the invention to provide an improved lid lock for a dumpster container which is simple and reliable and which can either be originally provided or retro-fitted to existing containers.

It is also an object of the invention to provide an improved lid lock which may be secured to containers which are either all metal or partially metal.

It is also an object of the invention to provide an improved lid lock which may be used on a wide variety of differently sized containers.

It is also an object of the invention to provide an improved lid lock which can be changed in a dimension easily to accommodate differently sized containers while not altering the basic operation of the locking mechanism.

It is also an object of the invention to provide an improved lid lock which automatically opens upon the pivoting of the container to open the hinged top of the container such that the container may be emptied and returned to its ground location without having to manually unlock the container.

It is finally an object of the invention to provide an improved lid lock which meets all of the above described features.

In the broader aspects of the invention, there is provided a locking mechanism for a container having a hinged lid comprising a shaft adapted to be secured to a container and journaled for rotation about its axis. A locking bar is removably secured to the shaft and rotatable about the axis with the shaft between a locked position and an unlocked position. A lock lever is secured to the shaft. Both the shaft and the lock lever are movable between a locked position and an unlocked position. A roller is mounted on a track over the lock lever for motion into and out of an engagement with a lock lever. The shaft is held from rotation when the roller and the locking bar is in the locking position. The locking bar is free to move into and out of its locked and unlocked position when the roller is moved from its locking position.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
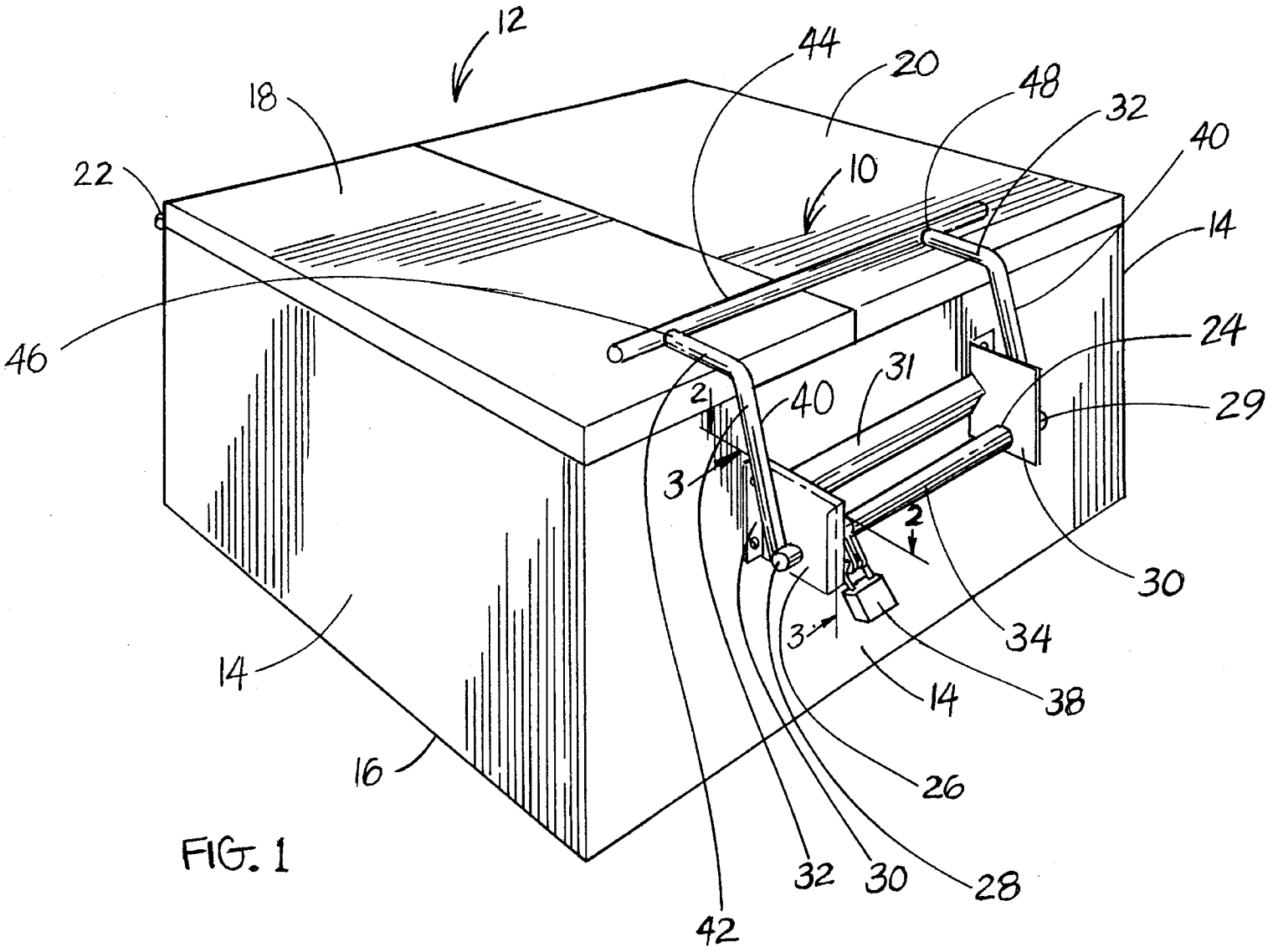
FIG. 1 is a perspective frontal view of the dumpster container showing the improved lid lock of the invention secured to the front of the container.
Figure 2:
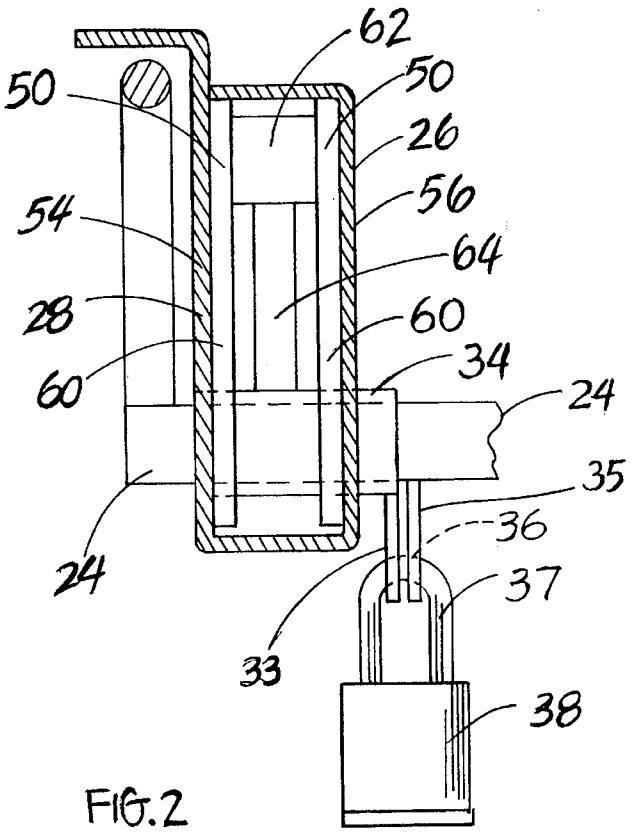
FIG. 2 is a cross-sectional view taken essentially along the section line 2—2 of FIG. 1 showing the detail of the present invention.

The improved lid lock 10 of the invention is shown in FIGS. 1 and 2 secured to a container 12 having metallic sides 14 and a metallic bottom 16. The container 12 is shown to have a pair of hinged lids 18, 20. The hinges 22 of both lids 18 and 20 are conventional, and in a specific embodiment, hinges 22 may be a single hinge 22. In other embodiments, container 12 may have only a single lid of the size of lids 18, 20 combined.

The lid lock 10 comprises a shaft 24 journaled in a box 26 secured to a flange 30 at one end 28 and journaled in a second flange or bracket 30 at the other end 29. At least one locking bar 32 is secured to shaft 24.

FIG. 1 shows two locking bars 32 of a L-shape such that one leg 40 of the "L" overlays the front side 14 of the container 12, respectfully and the other leg 42 of the locking bar 32 overlays the hinged lids 18, 20 of the container 12. A blocking bar 44 extends between the distal ends 46 and 48 of the two locking bars 32 to overlay with the locking bar legs 42, both lids 18, 20.

By providing shaft 24 and blocking bar 44 of different lengths, the lid lock 10 of the invention may be tailored to fit a variety of different sizes of containers 12.

In a specific embodiment, shaft 24, locking bars 32, and blocking bar 44 are all made of steel and connected together as shown in FIGS. 1 and 2 by welding.

Figure 3:
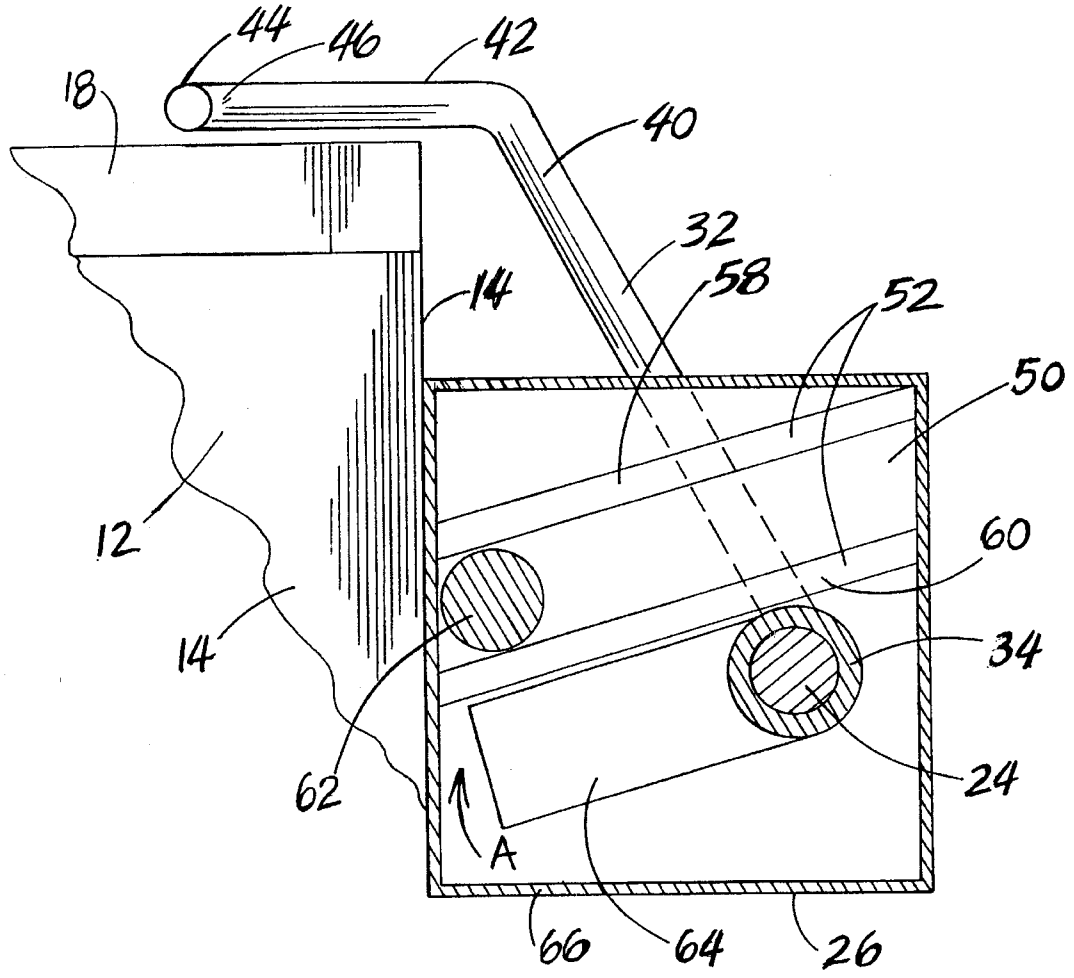
FIG. 3 is a cross-sectional view taken essentially along the section line 3—3 of FIG. 1 showing the improved locking mechanism of the invention in a locked position.
Figure 4:
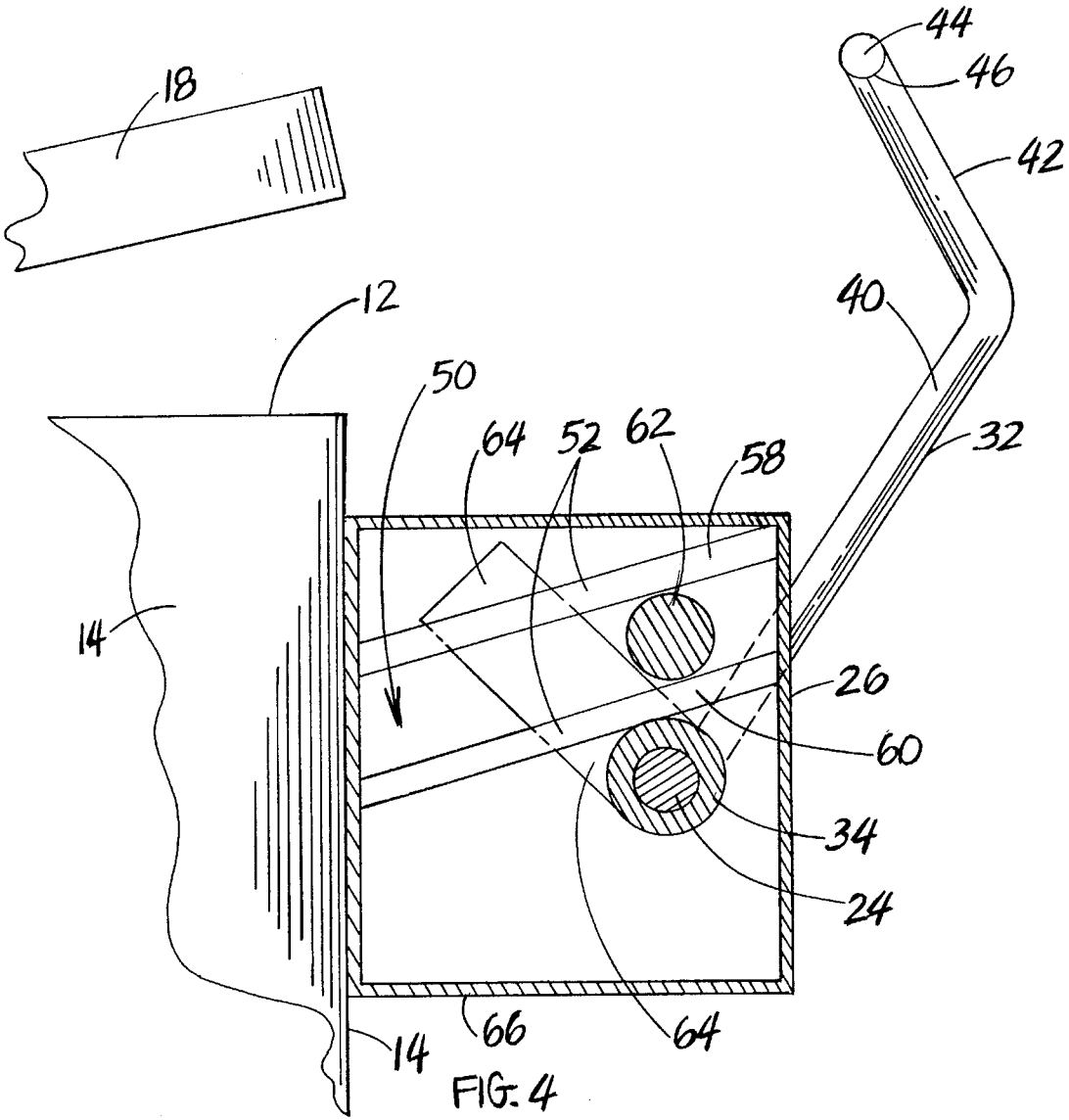
FIG. 4 is a cross-sectional view similar to that shown in FIG. 3 showing an improved lid lock of the invention in the unlocked position.

Referring now to FIGS. 2–4, the structure of box 26 will now be described. Shaft 24 is journaled in tube 34 which extends through the opposite sides 54, 56 of box 26. Tube 34 is also journaled in the opposite sides 54, 56 of box 26. Within box 26, railing 50 is positioned above shaft 24. Railing 50 comprises a pair of rails 52 secured to both opposite sides 54, 56. Each pair 52 includes an upper rail 58 and a lower rail 60 between which a roller 62 is positioned.

Secured to tube 34 is lock lever 64. Lock lever 64 rotates with tube 34 as suggested by the arrow A shown in FIG. 3.

Roller 62 is totally confined within railing 50 and between upper and lower rails 58 and 60. Roller 62 may roll from left to right as shown in FIG. 3 within the confines of railing 50. Tube 34 and shaft 24 are secured together in a locked condition. In a specific embodiment not shown, tube 34 and shaft 24 have a bore extending through both tube 34 and shaft 24 which are coaxial when blocking bar 44 overlays lids 18, 20 and roller 62 is in the far left position shown in FIG. 3. A padlock can be inserted through and positioned in the bore to accomplish the locking of the tube 34 and shaft 24 from rotational movement relative to each other and to secure the same together in a locked condition.

In another specific embodiment, ears 33, 35 are respectively welded to tube 34 and shaft 24. These ears rotate with both tube 34 and shaft 24, but are positioned side by side when the blocking bar 44 overlays lids 18, 20 and roller 62 is in the far left position as illustrated in FIG. 3. In this side by side condition, bores 36 extending through ears 33, 35 are coaxial and a padlock can be positioned in bore 36 to lock tube 34 and shaft 24 together from and prevent rotational movement relative to each other. See FIGS. 1 and 2.

Lock lever 64 may rotate together with tube 34 in its locked condition between the engagement of blocking bar 44 with lids 18, 20 and the engagement of lock lever 64 with roller 62 in its far right hand position. In a locked condition, lock lever 64 is nearly engaged with bottom 66, when blocking bar 44 is engaged with lids 18 and 20, and roller 62 is in the far left position shown in FIG. 3 and the blocking bar 44 is prevented by the roller 62 from moving from the lids 18, 20 when the box is sitting generally horizontally, without the removal of pad lock 38.

In the specific embodiment illustrated, railing 50 is angularly disposed with regard to the horizontal which is generally defined by bottom 66 in FIGS. 3 and 4 when the container 12 is placed on a generally horizontal surface. This angular positioning of railing 50 maintains roller 62 in the far left position shown in FIG. 3 by gravity. Roller 62 in the far left position shown in FIG. 3 prevents lock lever 64 from rotating above its engagement with roller 62. However, by tilting box 26 and container 12 forwardly, in the direction of arrow A, such that railing 50 becomes generally horizontal and beyond, roller 62 may roll to the right as shown in FIG. 4 within railing 50 and lock lever 64 may be rotated in the direction of angle A. When this happens, both tube 34 and shaft 24 rotate together and blocking bar 44 can be rotated out of engagement with lids 18, 20 even though pad lock 38 prevents tube 34 from rotating relative to shaft 24.

In a specific embodiment, railing 50 defines an angle with the horizontal from about 15° to about 20°.

In operation, the container 12 can be used as a waste receptacle. Any person having a key to the padlock 38 may remove the padlock 38 and the blocking bar 44 may be rotated forwardly out of engagement with the lids 18 and 20 and the lids 18 and 20 may be lifted to deposit waste and refuge in container 12. Once this operation bas been completed, locking bars 32 and blocking bar 44 may be rotated back into engagement with lids 18, 20 and padlock 38 repositioned within opening 36 locking lids 18, 20.

Whenever container 12 is emptied, container 12 is picked up by a refuge container and tipped forwardly in direction of angle A as shown in FIG. 3. As soon as the angle of railing 50 becomes horizontal and then is rotated further, the roller 62 will roll to the right from its position illustrated in FIG. 3 to the other end of railing 50 and the shaft 24 is free to rotate. Whenever the weight of blocking bar and locking levers overcome the frictional forces, shaft 24 and tube 34 and lock lever 64 will rotate in the direction of angle A and blocking bar 44 and locking levers 32 will disengage from lids 18, 20. Further rotation in the same direction will open lids 18, 20 and empty the contents from the container.

Once container 12 is emptied, the lift truck can rotate the container in the opposite direction of arrow A and re-sit container 12 at its intended location in a generally horizontal position. As this rotation is accomplished, locking bar 44 will rotate under the force of gravity in the direction opposite the direction indicated by arrow A and re-engage lids 18, 20 and roller 62 will roll within the confines of railing 50 into the position illustrated in FIG. 3 and lids 18, 20 will again be locked.

The improved container lock of the invention provides an improved lid lock which may be used on a dumpster container as original equipment or retro-fitted to a wide variety of different styles and sizes of containers which are either all metal or partially metal, and which is simple and reliable. The improved lid lock of the invention can be changed in dimension easily, provides a lid lock which automatically opens upon the pivoting of the container to open the hinged lid of the container such that the container may be emptied and returned to its ground location without having to manually unlock the container as in mechanized trash removal.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A lock for a container having a hinged lid comprising a shaft adapted to be secured to a container on the upstanding container side opposite the lid hinge, said shaft being journaled for rotation about its axis, a locking bar removably secured to said shaft and rotatable about said axis with said shaft between a locked position and an unlocked position, a lock lever secured to said shaft and movable with said shaft and said locking bar between said locked position and said unlocked position, and a roller mounted on a rail over said lock lever for motion into and out of a lever lock position, said shaft being held from rotation when said roller is in said lever lock position and said locking bar is in said locked position, said locking bar being free to move out of said locked position when said roller is moved from its lever lock position.

2. The lock of claim 1 further comprising a container, said container having a bottom and upstanding walls and a hinged lid, said walls and bottom and lid all being of metal construction.

3. The lock of claim 1 further comprising a container having a bottom, upstanding walls and a hinged lid, said bottom and upstanding walls being of all metal construction, said lid being of non-metal construction.

4. The lock of claim 1 wherein said roller is held in said lever lock position by gravity.

5. The lock of claim 1 wherein said rail is angularly disposed in relation to the horizontal.

6. The lock of claim 1 wherein said rail defines an angle with the horizontal when said container side is essentially vertical, said roller rolling out of said lever lock position when said container side defines an angle with a vertical greater than said angle, said roller being held by gravity in said lever lock position when said container side defines an angle with a vertical which is less than said angle.

7. The lock of claim 4 wherein said angle is from about 15° to about 20°.

8. The lock of claim 1 wherein said locking bar is a L-shaped bar which overlays the hinged lid of said container opposite its hinge when said locking bar is in said locked position.

9. The lock of claim 1 wherein said lock lever, roller and rail are positioned together within a box secured to said container side.

10. The lock of claim 9 wherein said track comprises a pair of spaced apart rods secured to opposite walls of said box, said roller being positioned between both said pairs and extends between said opposite side walls.

11. The lock of claim 9 wherein said shaft is journaled in said box.

12. The lock of claim 11 further comprising a tube journaled to said box, said shaft extending through said tube, said lock lever being secured to said tube, said tube and shaft being on the same axis, said tube and shaft being secured together in said locked position.

13. The lock of claim 11 wherein the other end of said shaft is journaled in a bracket secured to said container side, said box and said bracket being spaced apart, a pair of spaced apart locking bars are secured to said shaft, and a blocking bar extending between the distal ends of said locking bars.

14. The lock of claim 1 wherein said hinged lid is provided in two adjacent independently actuable lids, and said locking bar over lays adjacent portions of both of said adjacent lids.

15. The lock of claim 1 wherein said locking bar further comprises an elongated blocking bar extending between the distal ends of a plurality of locking bars between opposite sides of said container.

16. A lock for a container having a hinged lid comprising a shaft having opposite ends, said shaft being adapted to be secured to a container on the upstanding container side opposite the lid hinge, said shaft journaled for rotation about its axis, a locking bar removably secured to said shaft and rotatable about said axis with said shaft between a locked position and an unlocked position, a lock lever secured to said shaft and movable with said shaft and said locking bar between said locked position and said unlocked position, and a roller mounted on a track over said lock lever for motion into and out of a lever lock position, said shaft being held from rotation when said roller is in said lever lock position and said locking bar is in said locked position, said locking bar being free to move out of said locked position when said roller is moved from its lever lock position, said lock lever and roller and rod being positioned in a box secured to said container side, one end of said shafts being journaled in said box, the other of said shaft ends being journaled in a bracket secured to said container side, said box and bracket being spaced apart, a pair of spaced apart locking bars being secured to said shaft ends and a blocking bar extending between the distal ends of said locking bars, said track comprising two pair of spaced apart rods secured to opposite side walls of said box, respectively, said roller being positioned between said rods of said pairs and extending between said opposite walls.

17. A lock for a container having a hinged lid comprising a shaft having opposite ends, said shaft being adapted to be secured to a container on the upstanding container side opposite the lid hinge, said shaft journaled for rotation about its axis, a locking bar removably secured to said shaft and rotatable about said axis with said shaft between a locked position and an unlocked position, a lock lever secured to said shaft and movable with said shaft and said locking bar between said locked position and said unlocked position, and a roller mounted on a track over said lock lever for motion into and out of a lever lock position, said shaft being held from rotation when said roller is in said lever lock position and said locking bar is in said locked position, said locking bar being free to move out of said locked position when said roller is moved from its lever lock position, said lock lever and roller and rod being positioned in a box secured to said container side, one end of said shaft being journaled in said box, the other of said shaft ends being journaled in a bracket secured to said container side, said box and said bracket being spaced apart, a pair of spaced apart locking bars being secured to said shaft ends, and a blocking bar extending between the distal ends of said locking bars, said track comprising two pair of spaced apart rods secured to opposite side walls of said box, respectively said roller being positioned between both said pairs and extending between said opposite side walls, said roller being held in said lever lock position by gravity, said track being angularly disposed with regard to the horizontal when said container side is essentially vertical, said track defining an angle with the horizontal, said roller rolling out of said lever lock position when said container side defines an angle with a vertical greater than said angle, said roller being held by gravity in said lever lock position when said container side defines an angle with a vertical which is less than said angle.

18. The lock of claim 17 wherein said angle is from about 15° to about 20°.

19. A lock for a container having a hinged lid comprising a shaft having opposite ends, said shaft being adapted to be secured to a container on the upstanding container side opposite the lid hinge, said shaft journaled for rotation about its axis, a locking bar removably secured to said shaft and rotatable about said axis with said shaft between a locked position and an unlocked position, a lock lever secured to said shaft and movable with said shaft and said locking bar between said locked position and said unlocked position, and a roller mounted on a track over said lock lever for motion into and out of a lever lock position, said shaft being held from rotation when said roller is in said lever lock position and said locking bar is in said locked position, said locking bar being free to move out of said locked position when said roller is moved from its lever lock position, said lock lever and roller and rod being positioned in a box secured to said container side, one end of said shaft being journaled in said box, the other end of said shaft being journaled in a bracket secured to said container side, said box and said bracket being spaced apart, a pair of spaced apart locking bars being secured to said shaft, and a blocking bar extending between the distal ends of said locking bars, said track comprising two pair of spaced apart rods secured to opposite side walls of said box, respectively, said roller being positioned between said pairs and extending between said opposite side walls, respectively said roller being held in said lever lock position by gravity, said track being angularly disposed with regard to the horizontal when said container side is essentially vertical, said track defining an angle with the horizontal when said container side is essentially vertical, said roller rolling out of said lever lock position when said container side defines an angle with a vertical greater than said angle, said roller being held by gravity in said lever lock position when said container side defines an angle with a vertical which is less than said angle, said angle being from about 15° to about 20°, a tube journaled to said box, said shaft journaled to said tube, said lock lever being secured to said tube, said shaft and tube being on the same axis, said tube and shaft being secured together when in said locked position.

* * * * *